US007722159B2

(12) United States Patent
Hyakudome et al.

(10) Patent No.: US 7,722,159 B2
(45) Date of Patent: May 25, 2010

(54) INKJET HEAD AND INKJET RECORDING DEVICE

(75) Inventors: Takao Hyakudome, Nagoya (JP); Akiko Noguchi, Komaki (JP); Takeshi Asano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 368 days.

(21) Appl. No.: 11/364,081

(22) Filed: Mar. 1, 2006

(65) Prior Publication Data

US 2006/0203037 A1 Sep. 14, 2006

(30) Foreign Application Priority Data

Mar. 4, 2005 (JP) ..... 2005-060528

(51) Int. Cl.
*B41J 2/165* (2006.01)

(52) U.S. Cl. ..... 347/45; 347/20

(58) Field of Classification Search ..... 347/20, 347/29, 30, 32, 33, 45, 47, 54
See application file for complete search history.

(56) References Cited

U.S. PATENT DOCUMENTS 4,499,480 A * 2/1985 Takatori et al. ..... 347/42
5,393,580 A * 2/1995 Ma et al. ..... 428/29
5,444,468 A * 8/1995 Fukushima et al. ..... 347/14
5,563,640 A * 10/1996 Suzuki ..... 347/45
6,074,279 A * 6/2000 Yoshimura et al. ..... 451/37
6,592,964 B2 * 7/2003 Ahn et al. ..... 428/131

FOREIGN PATENT DOCUMENTS

JP A 06-344562 12/1994
JP A 2000-326514 11/2000

OTHER PUBLICATIONS

Merriam-Webster online dictionary for the definition of the word "several", Jul. 15, 2009.*

* cited by examiner

*Primary Examiner*—Shih-Wen Hsieh
(74) *Attorney, Agent, or Firm*—Oliff & Berridge, PLC

(57) ABSTRACT

There is provided an inkjet head including a nozzle plate in which a plurality of nozzles from which ink is ejected are formed. The nozzle plate has a nozzle surface on which nozzle orifices corresponding to the plurality of nozzles are formed. The nozzle surface has surface roughness Rz in a range from 0.3 to 5 μm formed by a roughening process. The ink has surface tension in a range from 28 to 35 mN/m.

8 Claims, 6 Drawing Sheets

INKJET HEAD AND INKJET RECORDING DEVICE

CROSS-REFERENCE TO RELATED APPLICATION

This application claims priority under 35 U.S.C. §119 from Japanese Patent Application No. 2005-060528, filed on Mar. 4, 2005. The entire subject matter of the application is incorporated herein by reference.

BACKGROUND

1. Technical Field

Aspects of the present invention relate to an inkjet recording device and an inkjet head which ejects ink onto a recording medium.

2. Description of Related Art

In general, an inkjet printer includes an inkjet head having more than one nozzles from which ink is ejected. In the inkjet head, a meniscus is formed at each tip portion (an ejection orifice) of each nozzle formed on a nozzle surface of a nozzle plate, and then a drop of ink is ejected from each ejection orifice by ink pressure supplied to each nozzle. In order to keep ink ejection performance at a constant level and to thereby keep an appropriate printing quality, the ink pressure is kept at a constant level.

There is a case where ink flowing over an ejection orifice of each nozzle adheres to the nozzle plate or ink bounced off a recording medium adheres to the nozzle plate. If one of such phenomena occurs, ink may accumulate on the nozzle plate and ink pools may appear on the nozzle surface.

If an ink pool caused as above hinders formation of a proper meniscus or an ink pool interferes with the ejection orifice, a steady ink ejection motion can not be kept. That is, there is a possibility that a nozzle becomes unable to eject ink or an ejection direction of ink becomes inappropriate.

As described above, the ink pools cause deterioration of imaging quality. In order to prevent generation of ink pools, one of conventional inkjet printers uses a nozzle plate to which a water repellent agent is applied.

In Japanese Patent Provisional Publication No. HEI 6-344562 (hereafter, referred to as JP HEI6-344562A), a manufacturing process for giving water repellency to a surface of a nozzle plate is disclosed. According to JP HEI6-344562A, a nozzle plate, made of a resin having transparency more than or equal to 10% to an excimer laser having a oscillation wavelength more than or equal to 193 nm, is employed, and a rough surface area in the vicinity of each nozzle on a surface of the nozzle plate is irradiated with the excimer laser in such a manner that the excimer laser does not interfere with a neighboring rough surface area. Consequently, improvement of ejection stability, attainment of wettability, separation of nozzle surfaces can be attained.

An another example of a manufacturing process for giving water repellency to a surface of a nozzle plate is disclosed in Japanese Patent Provisional Publication No. 2000-326514 (hereafter, referred to as JP 2000-326514A). According to JP 2000-326514A, a water repellent film having a thickness smaller than or equal to 0.5 μm is formed on a nozzle plate by subjecting a surface, provided with surface roughness (Ra) of 0.01 to 0.1 by surface roughening, to a process of plasma polymerization (CVD) using a fluorine compound or a silane compound.

In order to keep steady ink ejection performance, one of conventional inkjet printers is configured to periodically perform a wiping operation for wiping remaining ink off a nozzle surface.

As described above, the ink ejection performance can be kept using the above mentioned techniques of conventional inkjet printers. However, the conventional inkjet printer has a drawback that a water repellent layer of a nozzle plate is worn away by the periodically performed wiping operation and therefore the water repellent property deteriorates.

Meanwhile, use of ink having a relatively low surface tension is expected to show better performance of preventing generation of ink pools. However, use of ink having a relatively low surface tension deteriorates wettability and thereby it becomes difficult to uniformly wet the peripheral part of an ejection orifice of each nozzle. In this case, the formation of a proper meniscus and the steady ink ejection performance can not be attained.

SUMMARY

Aspects of the present invention are advantageous in that an inkjet head, configured to be capable of keeping steady ink ejection performance and thereby enhancing its lifetime, is provided.

BRIEF DESCRIPTION OF THE ACCOMPANYING DRAWINGS

DETAILED DESCRIPTION

General Overview

According to an aspect of the invention, there is provided an inkjet head including a nozzle plate in which a plurality of nozzles from which ink is ejected are formed. The nozzle plate has a nozzle surface on which nozzle orifices corresponding to the plurality of nozzles are formed. The nozzle surface has surface roughness Rz in a range from 0.3 to 5 μm formed by a roughening process. The ink has surface tension in a range from 28 to 35 mN/m.

With this configuration, a peripheral region of the nozzle orifice is wet uniformly. Therefore, the steady ink ejection performance can be attained. Since there is no necessity to form a water repellent film on the nozzle surface, it is possible to enhance life time of the inkjet head.

Optionally, the nozzle plate may be made of ceramic.

Still optionally, the ink may be aqueous ink.

Still optionally, the nozzle surface may have a roughened surface roughened by shot blast.

Still optionally, each of the nozzles may include a portion having a form of a horn aperture of which diameter increases toward the nozzle surface.

According to another aspect of the invention, there is provided an inkjet recording device, which is provided with the above mentioned inkjet head.

Optionally, the inkjet recording device may include a purge unit that has a suction cup configured to closely contact the nozzle surface of the inkjet head when the inkjet head is moved to a predetermined position.

Still optionally, the inkjet recording device may include a platen on which a recording medium is placed, and a driving mechanism that moves the inkjet head relative to the platen.

Illustrative Embodiments

Hereafter, an illustrative embodiment according to the invention will be described with reference to the accompanying drawings.

Figure 1:
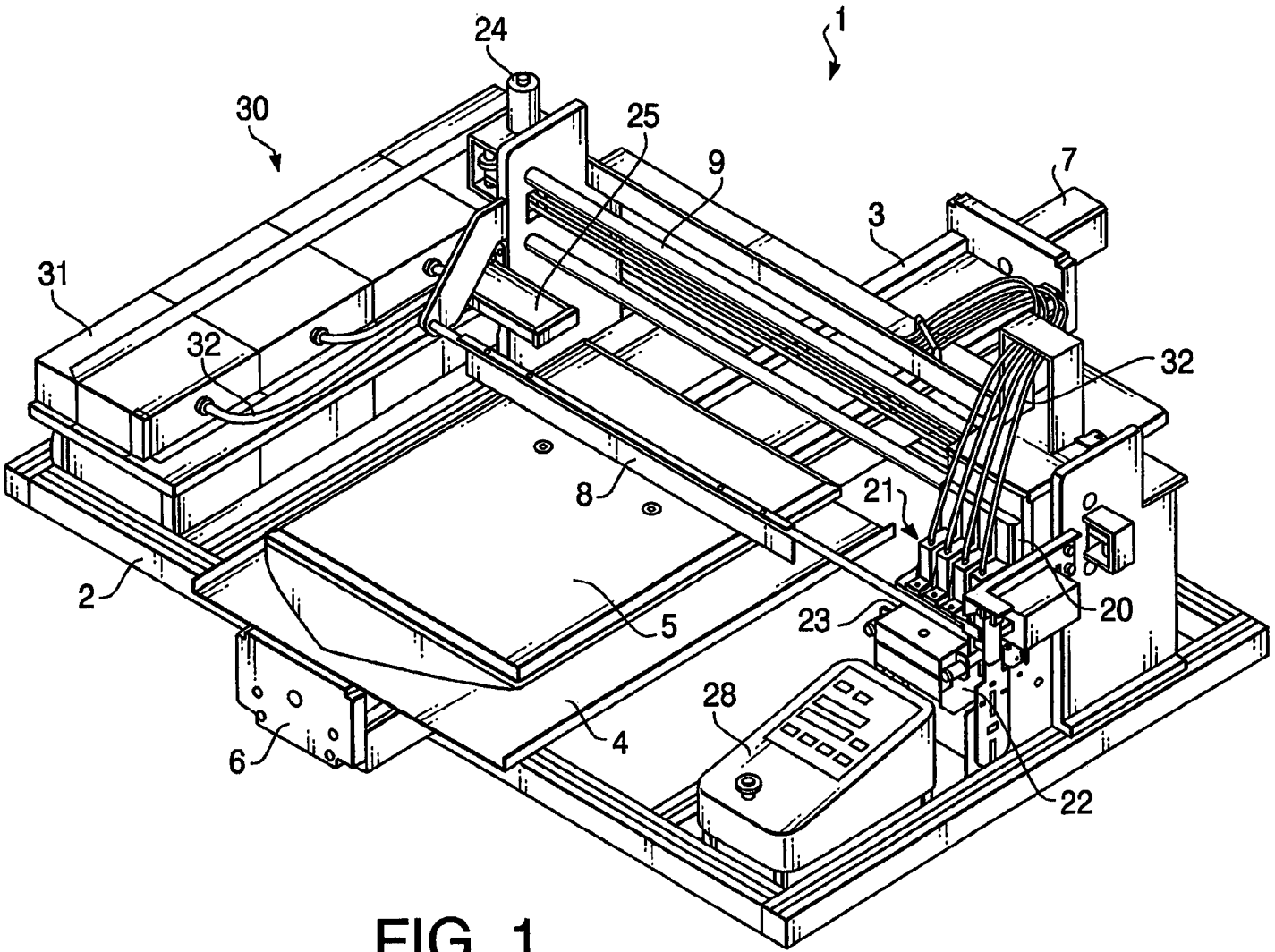
FIG. 1 is a perspective view of an inkjet printer 1 to which an inkjet head and an inkjet recording device according to an embodiment is applied.

FIG. 1 is a perspective view of an inkjet printer 1 to which an inkjet head and an inkjet recording device according to an embodiment is applied. The inkjet printer 1 is used to print images on fabric such as a T-shirt.

A configuration of the inkjet printer 1 will be described with reference to FIG. 1. The inkjet printer 1 includes a box-shaped housing 2 elongated in a lateral direction. Two rails 3 elongated along the back and forth direction of the housing 2 are located at the central portion of the bottom of the housing 2. The two rails 3 are held by a base part (not shown) of the housing 2 standing up in the vertical direction. A plate-like platen base (not shown) is held on the rails 3 slidably in the back and forth direction. A platen 5 is detachably attached to the top of a column standing from the central part of the platen base.

The platen 5 is a plate-like member elongated in the back and forth direction if it is viewed as a plan view. A recording medium (i.e., fabric in this embodiment) is loaded and held on the top surface of the platen 5. A tray 4 is fixed to the central portion of the column between the platen 5 and the platen base. The tray 4 prevents fabric (T-shirt) from falling to the bottom of the housing 2 when a user loads the fabric onto the platen 5.

At the rear edge of a platen driving mechanism 6 (including the rails 3), a platen driving motor 7 used to drive (i.e. reciprocates) the platen base in the back and forth direction along the rails 3 is provided.

Over the platen 5, a guide rail 9 is provided at the center position in the back and forth direction of the housing 2, bridging the top portions of side walls of the housing 2. The guide rail 9 guides movement of a carriage 20. By driving force of a carriage motor 24 located at the left side of the housing 2, the carriage 20 moves (i.e., reciprocates) along the guide rail 9 in the lateral direction.

Cyan ink, magenta ink, yellow ink and black ink are used in the inkjet printer 1. At the left side portion of the housing 2, four ink cartridges 31 respectively corresponding to the four colors are located. The four cartridges 31 are accommodated respectively in four cartridge containment portions 30. An ink supply tube 32 having flexibility is connected to each cartridge containment portion 30, and ink is introduced from the ink cartridge 31 to a corresponding inkjet head 21 through the corresponding ink supply tube 32.

Four inkjet heads 21 are provided in the carriage 20. Each inkjet head 21 has 128 ejection channels (not shown) and respective ejection nozzles located at the bottom surface thereof. Each of the ejection channels includes a piezoelectric actuator. In this structure, drops of ink are ejected from each nozzle downward onto fabric.

At the right edge of the guide rail 9, a purge unit 22 is located. The purge unit 22 includes a suction cup 23 capable of closely contacting or departing from a nozzle surface of each inkjet head 21. The purge unit 22 is also provided with a suction pump (not shown) serving to suck ink remaining on the nozzle surface of each inkjet head 21 and ink in each nozzle 14 (see FIG. 5) when the suction cup 23 closely contacts the nozzle surface of the inkjet head 21. The suction cup 23 covers the nozzle surface of each inkjet head 21 when a printing operation is not performed so that drying of ink in each nozzle is prevented.

At the right edge of the guide rail 9, a wiping mechanism (not shown) configured to wipe ink off the nozzle surface of the inkjet head 21 is also provided.

At the left edge portion of the guide rail 9, an ink tray 25 is provided. The ink tray 25 receives ink which is ejected from each inkjet head 21 for prevention of increase of viscosity of ink due to drying. A clearance sensor 8 elongated in the lateral direction is provided at the front of the guide rail 9. The clearance sensor 8 serves to detect impediments (e.g., wrinkles or debris on fabric loaded on the platen 5) to movement of the platen 5 in the back and forth direction during the printing operation. An operation panel 28 is provided at the right front portion of the housing 2. The operation panel 28 is provided with a display and various operation buttons including an print button, a stop button and a platen carrying button.

Figure 2:
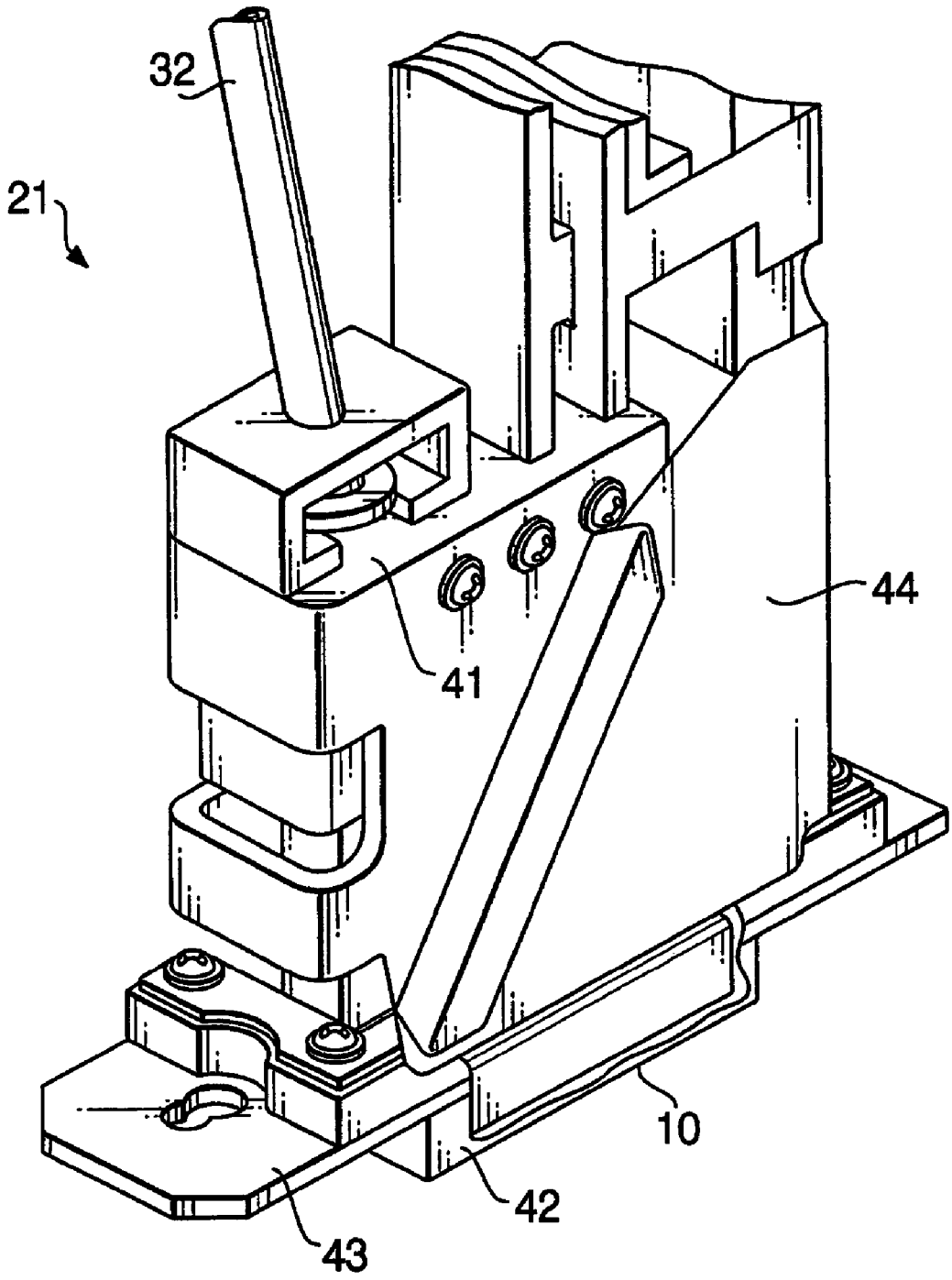
FIG. 2 is a perspective view of the inkjet head corresponding to one of colors.
Figure 3:
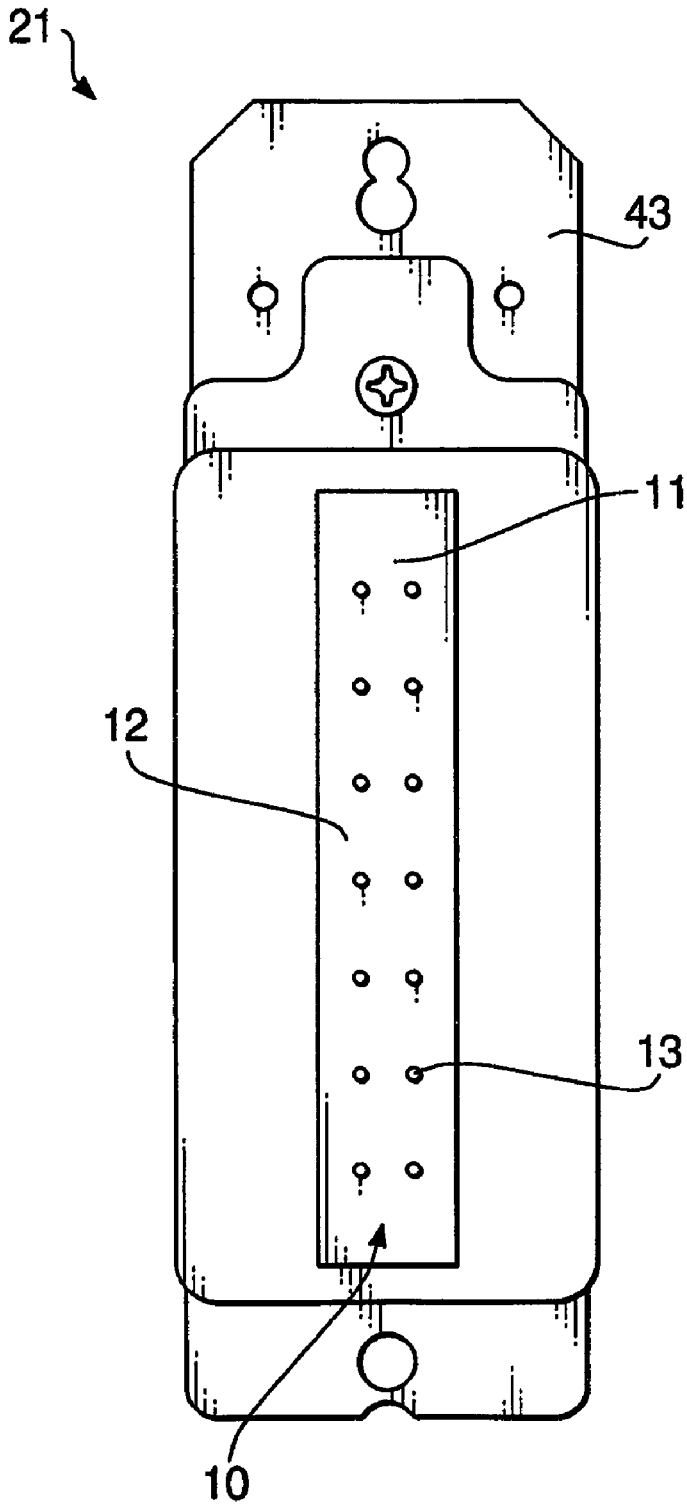
FIG. 3 is a bottom view of the inkjet head.

Hereafter, the inkjet head 21 will be explained in detail. FIG. 2 is a perspective view of the inkjet head 21 corresponding to one of ink colors used in the inkjet printer 1. FIG. 3 is a bottom view of the inkjet head 21. As shown in FIGS. 2 and 3, the inkjet head 21 has a rectangular shape elongated in a direction perpendicular to the reciprocating direction of the carriage 20 when viewed as a plan view. The inkjet head 21 has a sub-tank 41 having a form of a box, a head body 42 and a nozzle plate 10.

The sub-tank 41 stores temporarily ink supplied from the ink cartridge 31 through the ink supply tube 32. The head body 42 communicating with the sub-tank 41 is located on a bottom side of the sub-tank 41. The head body 42 is provided with more than one ejection channels (not shown). Specifically, the head body 42 is formed by adhering a flow channel unit, in which ink flow channels including pressure chambers are formed, to a piezoelectric actuator for applying pressure to ink in each pressure chamber.

On a bottom side of the head body 42, the nozzle plate 10 having a plate-like nozzle substrate 11, in which more than one ejection orifices 13 (nozzle orifices) are formed, is provided. The bottom surface of the nozzle plate 10 serves as a nozzle surface 12 from which ink is ejected downward.

The head body 42 and the nozzle plate 10 are fixed to the bottom surface of the sub-tank 41 by screws through a plate-like metal frame (bracket) 43. By this structure, the head body 42, the nozzle plate 10 and the sub-tank 41 form an integrated structure of the inkjet head 21. The sub-tank 41 is surrounded and protected by a metal attachment 44 having a cylindrical form and having a rectangular cross section. The inkjet head 21 is fitted into the carriage 20 from the upper side of the carriage 20 and is fixed to the carriage 20.

In the above mentioned configuration, ink is supplied from the sub-tank 41 to the flow channel by the driving force of the piezoelectric actuator, and the ink is ejected from the nozzle orifices 13 formed on the nozzle surface 12 onto a recording medium as drops of ink.

A general inkjet printer employs frequently oil-based ink (solvent ink) because oil-based ink exhibit a fast ink drying property. However, in the inkjet printer 1, aqueous ink is used considering an effect on a human body and environmental concerns. As an example, aqueous ink having the surface tension of 28 to 35 mN/m is used in the ink jet printer 1. For example, the aqueous ink is alkalescent and has pH of 7.5 to 8.5.

Figure 4:
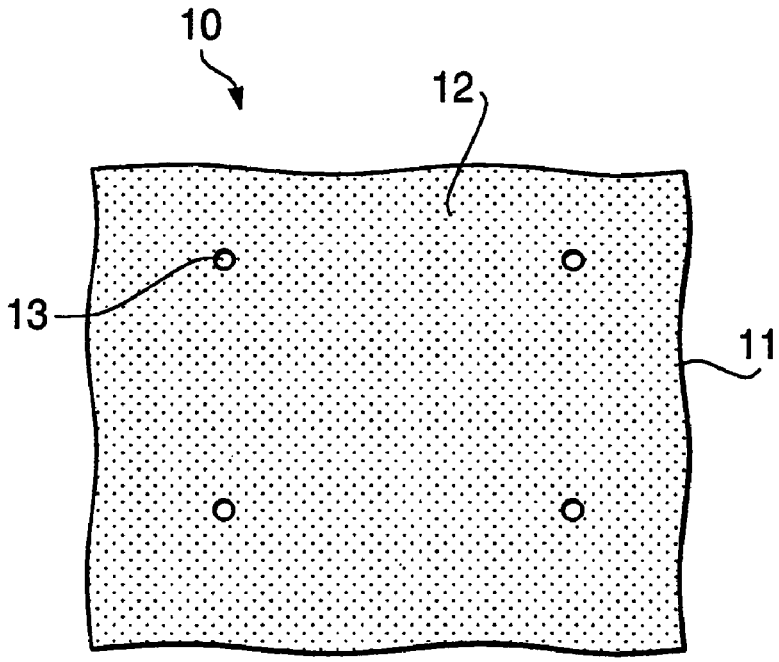
FIG. 4 is an enlarged plan view of a nozzle plate.
Figure 5:
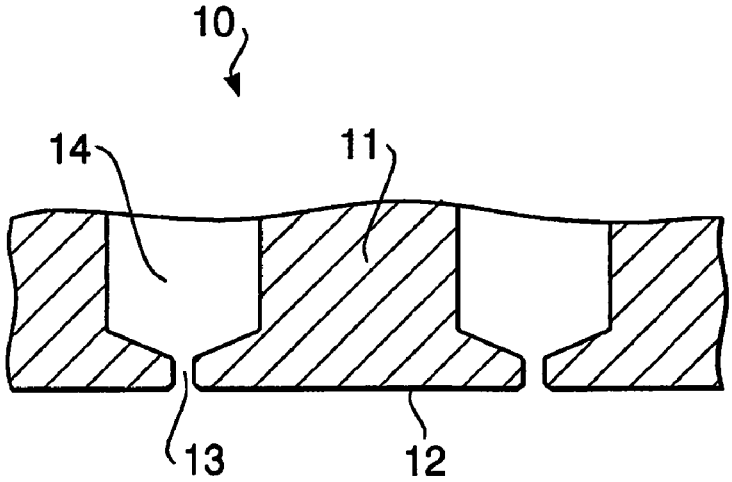
FIG. 5 is an enlarged side cross section of the nozzle plate.

Hereafter, the nozzle plate 10 will be explained. FIG. 4 is an enlarged plan view of the nozzle plate 10. FIG. 5 is an enlarged side cross section of the nozzle plate 10. In FIG. 4, a front side corresponds to a downward side in FIG. 2.

As shown in FIG. 4, the nozzle plate 10 has the nozzle surface 12 in which the nozzle orifices 13 are formed uniformly by micro-fabrication. The nozzle substrate 11 is a plate-like substrate made of ceramic.

In general, polyimide or stainless metal is used as material of a nozzle plate. However, in the inkjet printer 1, ceramic is used as material of the nozzle substrate 11 because polyimide is weak with respect to alkaline ink and a certain type of stainless metal may have the characteristic that rusts easily. The use of ceramic as material enables the nozzle substrate 11 to have adequate durability to alkaline ink.

A roughening process has been applied to the nozzle surface 12 so that minute ruggedness are formed on the nozzle surface 12. Specifically, the nozzle surface 12 is roughened in the surface roughness (Rz) between 0.3 and 5 μm. For example, shot blast, in which numerous ceramic shot balls (e.g., alumina or silicon dioxide) are shot toward a target at high velocity, may be used to roughen the nozzle surface 12.

As shown in FIG. 5, more than one nozzles 14, to which ink is supplied from the sub-tank 41, are formed inside the nozzle plate 10. Each nozzle 14 is formed such that a size of an opening becomes narrower at a point closer to the nozzle surface 12. At a tip of each nozzle 14 having the narrowest opening (i.e., at the lower end of the nozzle 14), the nozzle orifice 13 is formed such that the nozzle orifice 13 penetrates a lower end portion of the nozzle substrate 11 in a direction substantially perpendicular to the nozzle surface 12. The diameter of a tip end of each nozzle 14 (i.e., a nozzle diameter) may be between 35 and 50 μm. In this embodiment, the nozzle diameter is 42 μm.

In addition to roughening the nozzle surface 12, a region in the vicinity of each nozzle orifice 13 on the nozzle substrate 11 is shaved by shot blast so that a size of an opening of each nozzle orifice 13 is widened toward the nozzle surface 12 like a horn aperture.

Figure 6:
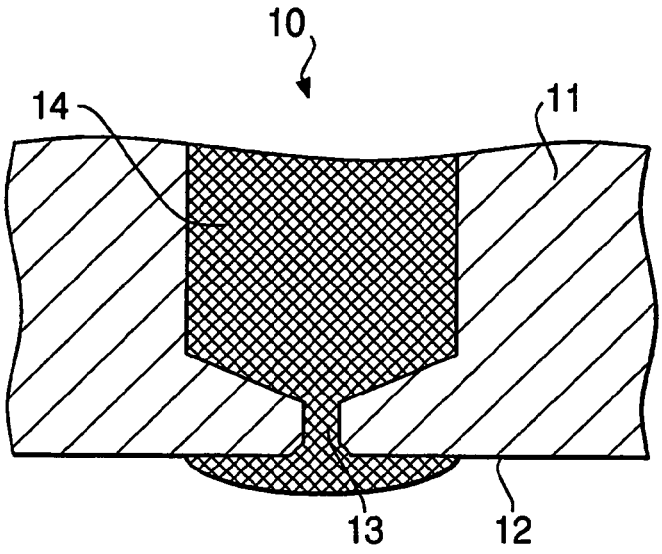
FIG. 6 is an enlarged side cross section of the nozzle plate illustrating a situation preceding a state in which a drop of ink is ejected.
Figure 7:
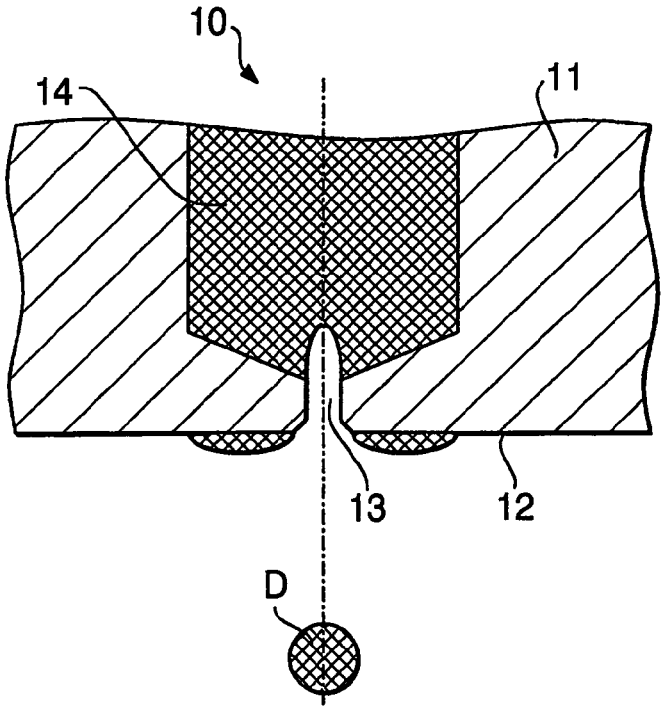
FIG. 7 is an enlarged side cross section of the nozzle plate illustrating the state in which a drop of ink is ejected.

Hereafter, an ink ejection motion of the nozzle plate 10 will be explained. FIG. 6 is an enlarged side cross section of the nozzle plate 10 illustrating a situation in which a meniscus is being formed (i.e., a situation occurring before a drop of ink is ejected). FIG. 7 is an enlarged side cross section of the nozzle plate 10 illustrating a state in which a drop of ink is ejected.

As show in FIG. 6, before a drop of ink is ejected, a meniscus is formed on the nozzle surface side of the nozzle orifice 13 by ink pressure supplied from the sub-tank 41 to the nozzle 14. Since the ink has a relatively low surface tension of 28 to 35 mN/m, and the nozzle surface 12 is roughened, the peripheral area of each nozzle orifice 13 is wet by ink such that ink forms an annular zone concentrically about the center of the nozzle orifice 13.

It is understood that force generated by ink remaining on the nozzle surface 12 acting to pull a drop of ink departing from the nozzle orifice 13 is weak because the surface tension of ink is 28 to 35 mN/m. The ink remaining on the nozzle surface 12 pulls a drop of ink uniformly from the region surrounding the drop of ink. Therefore, the surface tension of the meniscus (ink) is kept in a uniform state, by which a drop of ink on the nozzle surface 12 is prevented from being ejected in an inappropriate direction. Consequently, it becomes possible to eject a drop of ink D in an appropriate direction along an axial direction of the nozzle 14 (indicated by a double chain line in FIG. 7). The above mentioned ink ejection motion is continued until a printing operation is finished.

In the inkjet printer 1, an automatic purging operation for maintenance of the inkjet head 21 is performed repeatedly. For example, the purging operation may be performed at a time when a printing operation for 24 pieces of fabric has finished.

In the automatic purging operation, the carriage 20 is moved to the position of the purge unit 22 so that the suction cup 23 covers the nozzle surface 12 of the inkjet head 21, the ink is sucked from the inside of the nozzle 14, and the ink is ejected to the outside (hereafter, this motion is referred to as a purging motion). Next, the carriage 20 is moved to the position of the wiping mechanism, and then ink remaining on the nozzle surface 12 is wiped off the nozzle surface 12 so as to prevent ink pools from appearing (hereafter, this motion is referred to as a wiping motion).

Subsequently, the carriage 20 is moved to the position of the ink tray 25, and drops of ink are ejected as in the case of a normal ejecting operation (hereafter, this motion is referred to as a flushing motion). In the flushing motion, ink, air bubbles or debris pressed into the inside of the nozzle 14 by the wiping motion are ejected to the outside. By such maintenance for the inkjet head 21, the function of forming an appropriate meniscus is restored.

In this embodiment, the inkjet head 21 does not require a water repellent film on the nozzle surface 21. Therefore, the nuzzle surface 21 is prevented from being deteriorated by the automatic purging operation (namely by the wiping motion).

Figure 8:
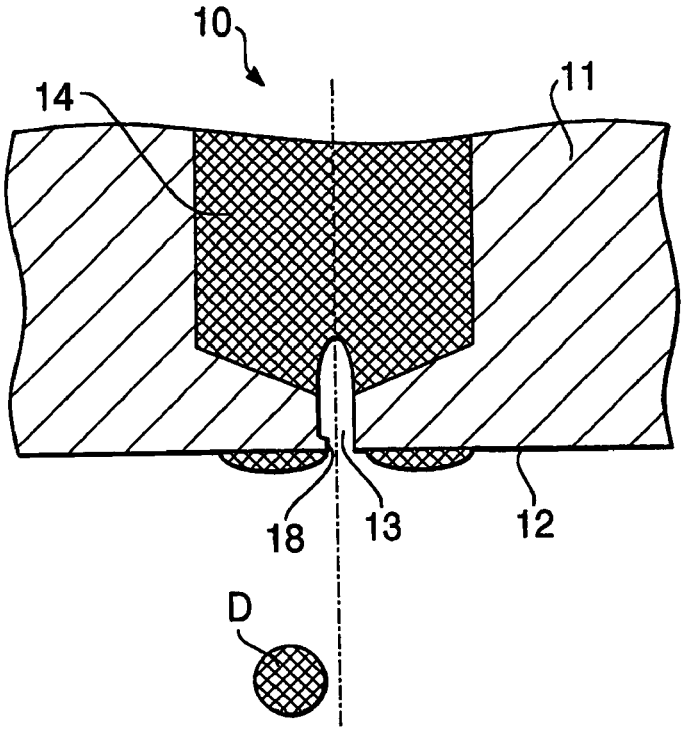
FIG. 8 is an enlarged side cross section in the vicinity of a nozzle orifice of the nozzle plate illustrating a situation where a roughening process has not been applied to a nozzle surface.
Figure 9:
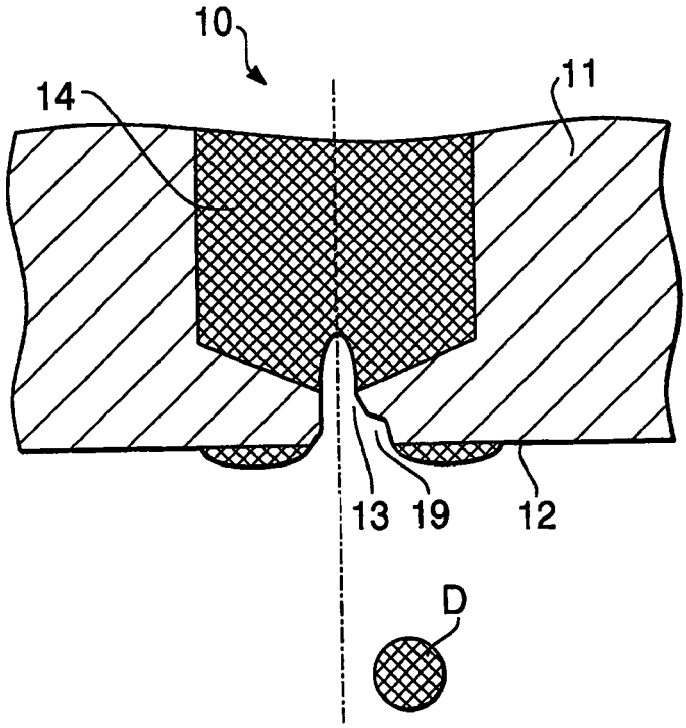
FIG. 9 is an enlarged side cross section of in the vicinity of the nozzle orifice of the nozzle plate illustrating a situation where a finish of the roughening process is relatively rough.

Hereafter, a relationship among the surface roughness (Rz) of the nozzle surface 21, the surface tension of ink, ejection performance of a drop of ink will be explained. Two comparative examples (undesirable situations) are illustrated in FIGS. 8 and 9. FIG. 8 is an enlarged side cross section in the vicinity of the nozzle orifice 13 of the nozzle plate 10 illustrating a situation where a roughening process has not been applied to the nozzle surface. FIG. 9 is an enlarged side cross section in the vicinity of the nozzle orifice 13 of the nozzle plate 10 illustrating a situation where a finish of the roughening process is relatively rough.

Table 1 shows the ink ejection performance evaluated by changing the surface tension of ink and the surface roughness. Specifically, the ink ejection performance is evaluated at points of the surface tension of ink of 28 mN/m, 30 mN/m, 33 mN/m, 35 mN/m, and 37 mN/m and points of the surface roughness (Rz) of "non-roughness (representing the case where roughening is not conducted)", 0.3 μm, 2 μm, 3 μm, 5 μm, and 7 μm. The evaluation is conducted in regard to the following criteria while repeating test printing (in which a predetermined image pattern is printed on fabric) for 24 pieces of fabric. In table 1, "O" represents a condition where the nozzle 14 which does not eject ink (a non-ejection pin) or the nozzle 14 which could not eject a drop of ink having an appropriate amount toward an appropriate position on fabric (an ink landing point faulty pin) is not found during the repeated test printing, and "x" represents a condition where a non-ejection pin or an ink landing point faulty pin is found during the repeated test printing.

TABLE 1

| | | nozzle surface roughness (μm) | | | | | |
|---|---|---|---|---|---|---|---|
| | | non-roughness | 0.3 | 2 | 3 | 5 | 7 |
| ink surface tension (mN/m) | 28 | X | ○ | ○ | ○ | ○ | X |
| | 30 | X | ○ | ○ | ○ | ○ | X |
| | 33 | X | ○ | ○ | ○ | ○ | X |
| | 35 | X | ○ | ○ | ○ | ○ | X |
| | 37 | X | X | X | X | X | X |

As can be seen from Table 1, the ink ejection performance deteriorates if the surface tension of ink is larger than or equal to 37 mN/m. This means that if the surface tension of ink is larger than or equal to 37 mN/m, ink pools appear on the nozzle surface 12 and the ink pools interfere with a proper ejection motion of a drop of ink or cause a drop of ink to be ejected in an inappropriate direction. In other words, if the surface tension of ink is smaller than or equal to 35 mN/m, the occurrence of a non-ejection pin or an ink landing point faulty pin can be prevented, and therefore yield of the inkjet head 21 can be enhanced.

On the other hand, if the surface tension is excessively small, the wettability of ink on the nozzle surface 12 becomes unstable. In other words, if the surface tension is excessively small, it becomes difficult to wet a peripheral region of the nozzle orifice 13 concentrically and uniformly, and therefore it becomes impossible to obtain an appropriate meniscus and attain the steady ink ejection performance. From the above mentioned experiment, the inventor found that use of ink having a surface tension larger than or equal to 28 mN/m is preferable.

As shown in Table 1, the ink ejection performance deteriorates if the surface roughness of the nozzle surface 12 is "non-roughness" regardless of the magnitude of the surface tension of ink. As described above, the nozzle 14 is formed in the nozzle substrate 11 such that the narrowed tip portion of the nozzle 14 (i.e., the nozzle orifice 13) penetrates the nozzle substrate 11 in a direction substantially perpendicular to the nozzle surface 12. There is a case where traces of shaving or projections (burrs) remain in the ink flow channel located in the vicinity of the nozzle orifice 13 depending on the condition and accuracy of micro fabrication. Such traces of shaving or projections become a cause of interfering with the proper ink ejection (i.e., a cause of generating a non-ejection pin or an ink landing point faulty pin). In FIG. 8, such an undesirable situation is illustrated.

In FIG. 8, a burr 18 remains in the ink flow channel. If such a burr 18 appears in the ink flow channel, a drop of ink to be ejected from the nozzle orifice 13 hitches onto the burr 18, and thereby the ejection direction of a drop of ink D is bent leftward. For this reason, in this embodiment, the roughening process is applied to the nozzle surface 12 because the roughness process makes it possible to smooth the ink flow channel by removing traces of shaving or projections (burrs) from the ink flow channel in the vicinity of the nozzle orifice 13.

On the other hand, if the surface roughness (Rz) is larger than or equal to 7 μm, the ink ejection performance deteriorates because of the excessively large surface roughness. In other words, if the diameter of a blast particle is excessively large, the peripheral region of the nozzle orifice 13 is shaved excessively and thereby a crack is caused in the vicinity of the nozzle orifice 13. Such a crack appeared in the vicinity of the nozzle orifice 13 may become a cause of a non-ejection pin or an ink landing point faulty pin, by interfering with the generation of a proper meniscus and bending the ink ejection direction. In FIG. 9, such an undesirable situation is illustrated.

In FIG. 9, a crack 19 is caused in the vicinity of the nozzle orifice 13. If such a crack is caused, a drop of ink to be ejected from the nozzle orifice 13 is guided by the crack 19 and thereby the ejection direction of a drop of ink D is bent rightward. For this reason, in this embodiment, the roughness process is applied to the nozzle surface 12.

In regard to obtaining excellent ejection performance of the nozzle plate 12, the surface roughness (Rz) in a range of 0.3 μm to 5 μm and the surface tension of ink in a range of 28 mN/m and 35 mN/m are preferable.

As describe above, according to the embodiment, the surface roughness (Rz) is in a range of 0.3 μm to 5 μm and the surface tension of ink is in a range of 28 mN/m and 35 mN/m. Therefore, the peripheral region of the nozzle orifice is wet uniformly, and the steady ink ejection performance can be attained. Since there is no necessity to form a water repellent film on the nozzle surface, it is possible to enhance life time of the inkjet head 21.

Since the nozzle plate 10 is made of ceramic, the nozzle plate 10 exhibits excellent durability to alkalescent aqueous ink, and therefore it becomes possible to appropriately record images onto a recording medium using aqueous ink. Since the roughening process is applied to the nozzle surface 12 by shot blast, it is possible to obtain an appropriate roughened surface on the nozzle plate 10 made of ceramic.

Although the present invention has been described in considerable detail with reference to certain preferred embodiments thereof, other embodiments are possible.

For example, a time when the automatic purge operation is executed may be preprogrammed or may be determined by a user, although in the above mentioned embodiment the automatic purge operation is executed repeatedly each time 24 pieces of fabric have been subjected to the printing operation.

In the above mentioned embodiment, alkalescent aqueous ink is used and the nozzle plate 10 is made of ceramic. However, a different type of ink or the nozzle plate 10 made of different material may be employed in the inkjet printer 1 depending on uses of the inkjet printer 1. For example, oil-based ink or acid ink may be used. The nozzle plate 10 may be made of metal such as stainless or polyimide.

A roughening process other than shot blast may be employed to roughen the nozzle surface 12 of the nozzle plate 10. For example, water blast using water or chemical etching may be employed to roughen the nozzle surface 12.

Although in the above mentioned embodiment, the inkjet head according to the embodiment is applied to the inkjet printer for printing images on fabric. However, the inkjet head according to the embodiment may be applied to various types of inkjet printers such as a printer designed to print images on paper, a line printer or a bubble jet printer.

What is claimed is:

1. An inkjet head, comprising:

a head body; and a nozzle plate in which a plurality of nozzles from which ink is ejected are formed, the nozzle plate including a first surface adjacent to the head body and a second surface opposite the first surface, wherein:

the second surface has nozzle orifices corresponding to the plurality of nozzles;

the second surface has a surface roughness Rz in a range from 2 to 5 μm formed by a roughening process; and the ink has a surface tension in a range from 28 to 35 mN/m.

2. The inkjet head according to claim 1, wherein the nozzle plate is made of ceramic.

3. The inkjet head according to claim 1, wherein the ink is aqueous ink.

4. The inkjet head according to claim 1, wherein the second surface has a roughened surface roughened by shot blast.

5. The inkjet head according to claim 1, wherein each of the nozzles includes a portion having a form of a horn aperture of which diameter increases toward the second surface.

6. An inkjet recording device, comprising the inkjet head according to claim 1.

7. The inkjet recording device according to claim 6, further comprising a purge unit that has a suction cup configured to closely contact the second surface of the inkjet head when the inkjet head is moved to a predetermined position.

8. The inkjet recording device according to claim 6, further comprising:

a platen on which a recording medium is placed; and a driving mechanism that moves the inkjet head relative to the platen.

* * * * *